US005591930A

United States Patent [19]

Kakishita et al.

[11] Patent Number: 5,591,930

[45] Date of Patent: Jan. 7, 1997

[54] ELECTRONIC MUSICAL INSTRUMENT PERFORMING MULTI-TASK PROCESSING

[75] Inventors: Masahiro Kakishita; Toshifumi Kunimoto, both of Hamamatsu, Japan

[73] Assignee: Yamaha Corporation, Japan

[21] Appl. No.: 329,088

[22] Filed: Oct. 25, 1994

[30] Foreign Application Priority Data

Oct. 29, 1993 [JP] Japan ..... 5-292420

[51] Int. Cl.[6] ..... G10H 7/00

[52] U.S. Cl. ..... 84/602; 364/140; 395/800

[58] Field of Search ..... 84/600, 601, 602, 84/609, 610; 364/133, 134, 140, 191, 192; 395/375, 800

[56] References Cited

U.S. PATENT DOCUMENTS 5,270,476 12/1993 Rokkaku et al. ..... 84/609
5,280,129 1/1994 Yamamori et al. ..... 84/656
5,341,440 8/1994 Earl et al. ..... 382/56
5,442,789 8/1995 Baker et al. ..... 395/650

FOREIGN PATENT DOCUMENTS 5-249956 9/1993 Japan .

*Primary Examiner*—William M. Shoop, Jr.
*Assistant Examiner*—Marlon Fletcher
*Attorney, Agent, or Firm*—Graham & James LLP

[57] ABSTRACT

In a buffer memory are stored messages given to a specific task in order of arrival. Messages of same types may be stored in the buffer memory. In a different order from the order of arrival, a processing section performs task processing on the basis of the messages stored in the buffer memory. If two messages of a same type are present in the buffer memory, one of the messages which has arrived later than the other is processed with priority irrespective of the order of arrival, and the other message which has arrived earlier is deleted from the buffer memory. If there is present in the buffer memory such a message instructing transfer of parameters corresponding to a function that is not currently assigned, this message itself is deleted from the buffer memory as being ineffective, so as to process a next message.

8 Claims, 6 Drawing Sheets

| TASK PRIORITY ORDER | NAME OF TASK |
|---|---|
| 1 | MIDI DRIVER TASK |
| 2 | PANEL MONITOR TASK |
| 3 | PANEL SCAN TASK |
| 4 | DISPLAY DRIVER TASK |
| 5 | EXTERNAL EFFECT TASK |

ELECTRONIC MUSICAL INSTRUMENT PERFORMING MULTI-TASK PROCESSING

BACKGROUND OF THE INVENTION

The present invention relates to an electronic musical instrument which performs various processes using multi-task techniques.

A typical example of an electronic musical instrument which performs various processes using multi-task techniques is disclosed such as in Japanese Patent Laid-open Publication No. HEI 5-249956.

Ordinarily, the multi-task processing is performed by assigning priority order to individual tasks, and the inter-task communication is provided by issuing a message directed to another task. The issued message is temporarily stored in a buffer so as to be processed when the other task is activated.

However, the above-mentioned conventional task-processing may suffer from the following inconvenience if the priority order and message buffering system are taken into account.

If message transfer occurs in succession with respect to a particular task of relatively low priority order, many messages of a same type will be accumulated in the buffer. These messages are processed in the order of arrival at the task, and so, in such a case where all the messages in the buffer are processed, processing of the messages of the same type will be repetitively performed a plurality of times.

For example, let it be assumed that, for a task for carrying out an effect imparting process in an electronic musical instrument based on real-time processing, two messages for changing an effect type are transmitted to the task and stored into the buffer before the task is activated. In such a case, it is the second, i.e., succeeding effect type changing message that becomes ultimately effective, and the first, i.e., preceding message does not have any influence even if it is ever processed. In other words, immediately after the preceding effect type changing message is processed, the succeeding effect type changing message of the same type is again processed, and thus the processing of the preceding message results in a mere waste of time. In this way, sequential processing of the messages in the order of their arrival would very often presents the inconvenience as noted above.

The reason why many messages are accumulated in the buffer is that the task processing the messages is essentially of low priority order. Accordingly, it is also provable that another task is called upon before all the contents of the buffer are processed. In such a case, if the messages are always processed in the order of their arrival, the last-arriving and most effective message is not immediately reflected, with the result that the processing tends to be entirely based on an old message without the effective message being processed.

SUMMARY OF THE INVENTION

It is therefore an object of the present invention to provide an electronic musical instrument which is provided with such a task processing function as to efficiently process messages accumulated in a buffer.

In order to achieve the above-mentioned object, the present invention provides an electronic musical instrument provided with a multi-task processing function, which comprises a buffer memory section for storing messages directed to a specific task in order of arrival, and a processing section for performing message processing on the basis of the messages stored in the buffer memory section, in a different order from the order of arrival.

The buffer memory section stores messages given to a specific task in order of their arrival. Some of the messages may belong to same types, and thus messages of the same types may be stored in the buffer memory section in the order of arrival. Where messages of a same type are stored, e.g., where a pitch change message and a distortion message are stored in the buffer memory section, in the order of this mentioning, both as an effect type change instructing message, the succeeding distortion message is ultimately validated (made effective) rather than the preceding pitch change message, and hence the succeeding message must be processed first. So, in a different order from the order of arrival, the processing section performs task processing on the basis of the messages stored in the buffer memory section. Namely, if, for example, two messages of a same type are present in the buffer memory section, one of the messages which has arrived later than the other is processed or executed with priority irrespective of the order of arrival, and the other message which has arrived earlier is either deleted from the buffer memory section or processed as not having existed from the beginning. Further, where there is present a message instructing transfer of parameters corresponding to a function that is not currently assigned, this message is deleted from the buffer memory section as being ineffective or processed as not having existed from the beginning.

As mentioned above, since the electronic musical instrument in accordance with the present invention determines the contents of the messages stored in the buffer memory section and performs message processing on the basis of the determination results in a different order from the order in which the messages have arrived, it is possible to process the messages accumulated within a specific task with utmost efficiency.

Now, the preferred embodiments of the present invention will be decsribed in detail below with reference to the accompanying drawings.

DETAILED DESCRIPTION OF THE PREFERRED EMBODIMENTS

Figures 1, 2:
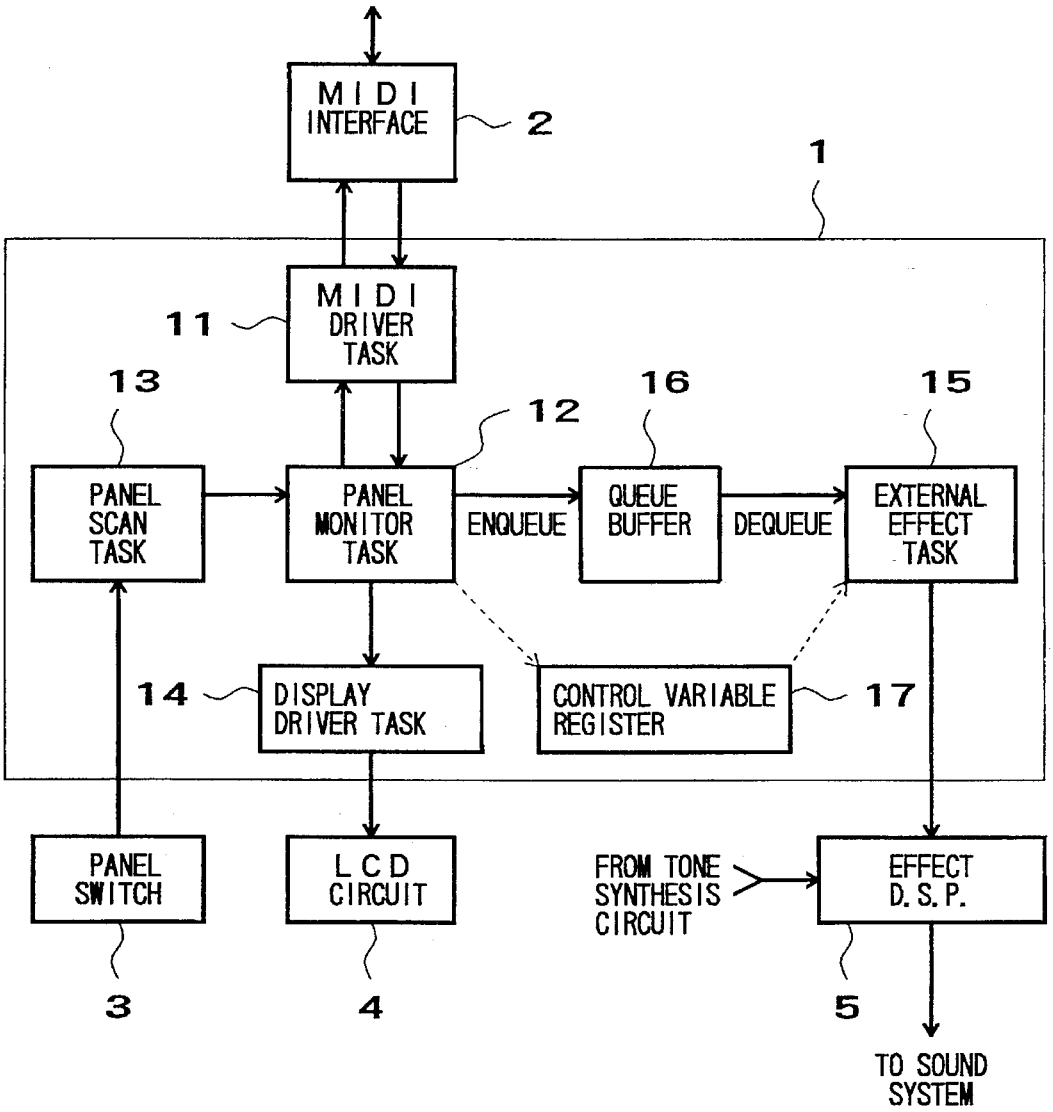
FIG. 1 is a block diagram illustrating the general structure of a control section of an electronic musical in accordance with an embodiment of the present invention which operates on the basis of a multi-task processing system.
FIG. 2 is a diagram illustrating the priority order of multiple tasks carried out by a microcomputer in the embodiment.

FIG. 1 is a block diagram showing the principal components of a control section of a multitask-type electronic musical instrument in accordance with an embodiment of the present invention.

A microcomputer 1, which controls the entire operation of the electronic musical instrument, comprises a microprocessor, a ROM, a RAM etc although they are not specifically shown in the drawings. In FIG. 1, the structure of the microcomputer 1 is shown in functional block diagram.

In accordance with a predetermined priority order as shown in FIG. 2, the microcomputer 1 operates multiple tasks which, in this embodiment, comprise five tasks: a MIDI driver task 11; a panel monitor task 12; a panel scan task 13; a display driver task 14 and an external effect task 15. Between the panel monitor task 12 and the external effect task 15 are provided a queue buffer 16 to be used for inter-task communication and a control variable buffer 17. Predetermined areas of the RAM are assigned as the queue and control variable buffers 16 and 17. The control variable register 17 is not directly concerned with this embodiment but is concerned with another embodiment as will be described later in relation to FIG. 9.

Of the above-mentioned multiple tasks, the MIDI driver task 11 has the highest priority "1", and the external effect task has the lowest priority "5". Between these highest and lowest priority tasks, the panel monitor task 12 has priority "2", the panel scan task 13 has priority "3", and the display driver task 14 has "4".

The MIDI driver task 11 exchanges MIDI (Musical Instrument Digital Interface) signals (i.e., data based on MIDI standards) with external MIDI equipments, via a MIDI interface 2.

The panel scan task 13 scans panel switches 3 provided on the body of the electronic musical instrument, so as to provide the panel monitor task 12 with a switch event signal that indicates which of the panel switches has been operated in what manner. The panel switches 3 includes various operators for selecting, setting and controlling tone color, volume, effect etc of tones to be generated.

The panel monitor task 12 receives the switch event signal from the panel scan task 13, so as to determine how internal parameter should be changed in accordance with the received signal. The panel monitor task 12 then writes into the queue buffer 16 a parameter change message indicative of the changed contents. Hereinafter, for convenience of description, writing of the message into the queue buffer 16 will be termed "enqueue", while reading of the message from the queue buffer 16 will be termed "dequeue".

The display driver task 14 outputs the contents of parameter change to an LCD (Liquid Crystal Display) circuit 4, which in turn displays the parameter change contents on an LCD panel.

The external effect task 15 reads out all the messages stored in the queue buffer 16 and determines, in accordance with the respective contents of the read-out messages, a specific processing order of the messages which is different from the order in which the messages were originally stored in the buffer 16, so that the task 15 changes parameters contained in an effect-oriented digital signal processor (D. S. P.) 5.

In accordance with the parameters changed by the external effect task 15, the effect-oriented digital signal processor 5 performs operations to impart a desired effect to a tone signal provided from a tone synthesis circuit and outputs the thus effect-imparted tone signal to a sound system.

Figure 3:
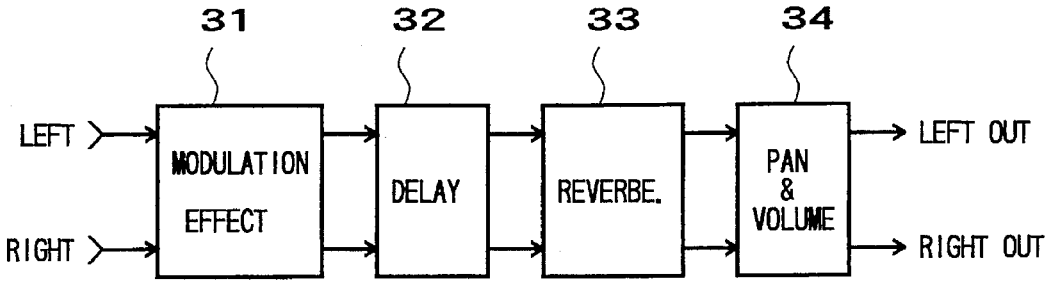
FIG. 3 is a block diagram illustrating the detail of effect imparting processing carried out by an effect-oriented digital signal processor of FIG. 1.

FIG. 3 is a block diagram illustrating the detail of an effect imparting process carried out by the effect-oriented digital signal processor 5. The effect imparting process includes a modulation effect process 31, a delay process 32, a reverberation process 33 and a pan and volume process 34.

In the modulation effect process 31, left- and right-channel tone signals R and L are received from the tone synthesis circuit (not shown), and any of three effects, flanger, pitch changer and distortion effects is imparted to the tone signals L and R, or none of such effects is imparted to the tone signals L and R. The term "flanger" as used herein refers to an effect imparting operation which achieves an effect of the ascending or descending sound of a jet plane by slightly delaying an input sound within a range of 1 ms to 10 ms and adding the thus-delayed input sound to an original sound. The term "pitch changer" refers to an effect imparting operation which varies the pitch of an input sound. In addition, the term "distortion" refers to an effect imparting operation which passes an input sound through a non-linear element, transmission system of poor transient performance or the like so as to provide certain signal component that is not present in an original sound, or removes certain signal component of an original sound by clipping off the upper and lower portions of an input sound waveform so as to intentionally distort the input sound.

The delay process 32 receives the left- and right- channel tone signals L and R from the modulation effect process 32, and then the process 32 either performs any of an independent delay operation for delaying the signals L and R from the modulation effect process 31 independently of each other and a cross-delay operation for delaying the signals L and R in a crossing manner, or does not perform any operation at all.

The reverberation process 33 receives the left- and right-channel tone signals L and R from the delay process 32, and then the process 33 either performs a reverberation tone generation operation by combining multiple reflected sounds of different delay times, or does not perform any operation at all.

The pan and volume process 34 controls the phase, volume etc. of the left- and right- channel tone signals L and R received via the above-mentioned various processes (modulation effect, delay and reverberation processes 31, 32 and 33), so as to determine their tone image position (localization) and volume.

Figure 4:
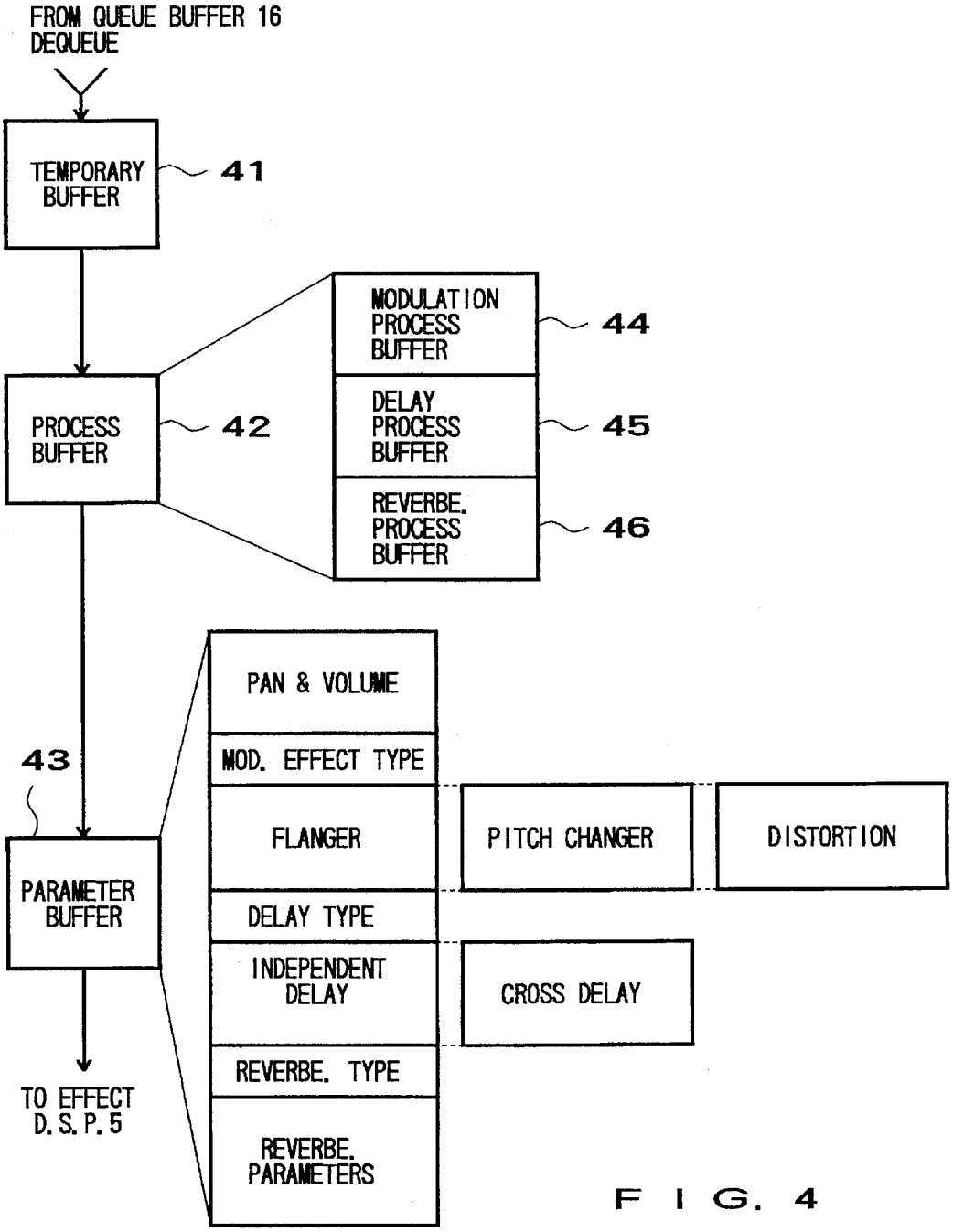
FIG. 4 is a diagram illustrating the outline of buffers which are used as an external effect task of FIG. 1 performs task processing.

FIG. 4 is a diagram illustrating the general structure of buffers that are used as the external effect task 15 carries out its task processing. As shown, the external effect task 15 uses a temporary buffer 41, a process buffer 42 and a parameter buffer 43 in performing the task processing.

The temporary buffer 41 temporarily stores all the messages dequeued from the queue buffer 16.

The process buffer 42 selectively stores any of the messages contained in the temporary buffer 41 which is considered useful for task processing. This process buffer 42 is composed of a modulation process buffer 44 for storing a message indicative of the contents of the modulation effect process 31, a delay process buffer 45 for storing a message indicative of the contents of the delay process 32, and a reverberation process buffer 46 for storing a message indicative of the contents of the reverberation process 33.

Further, the parameter buffer 43 is provided for storing parameters to be supplied to the effect-oriented D. S. P. 5, which operates in accordance with the contents of the parameter buffer 43.

The parameter buffer 43 includes a plurality of areas for storing various parameters. A pan and volume area of the parameter buffer 43 stores processing parameters for the pan and volume process 34 shown in FIG. 3.

A modulation effect type area of the parameter buffer 43 stores data indicative of the contents of an operation being performed by the modulation effect process 31 of FIG. 3 (i.e., data indicating which of the three effect imparting operations, flanger, pitch changer and distortion effect imparting operations, is being performed or indicating that none of the operations is being performed). Accordingly, this modulation effect type area has plural subareas for storing different kinds of parameters corresponding to the different processes. In the figure, the modulation effect type area is shown as storing parameters for the flanger effect imparting operation; however, if the modulation effect type is pitch changer or distortion, the area, of course, stores parameters for the pitch changer or distortion effect.

A delay type area of the parameter buffer 43 stores data indicative of the contents of an operation being performed by the delay process 32 of FIG. 3 (i.e., data indicating which of the independent delay and cross-delay operations is being performed or indicating that neither of the two operations is being performed). Accordingly, this delay type area has plural subareas for storing different kinds of parameters corresponding to the different operations. In the figure, the delay type area is shown as storing parameters for the independent delay operation; however, if the delay type is the cross-delay operation, this area stores parameters for the independent delay operation.

A reverberation type area of the parameter buffer 43 stores data indicative of an operation being performed by the reverberation process of FIG. 3. Accordingly, this reverberation type area has a subarea for storing parameters for such an operation being performed.

The parameter change messages that are enqueued into the queue buffer 16 by the panel monitor task 12 includes one for instructing change in common parameters such as pan and volume, one for instructing a change in the modulation effect type, one for instructing change in individual parameters of the modulation effects(flanger, pitch changer and distortion), one for instructing a change in the delay type, one for instructing change in individual parameters of the independent and cross-delay operations, one for instructing a change in the reverberation type, for instructing change in individual reverberation parameters, and one for instructing "bulk dump", etc.

Figure 5:
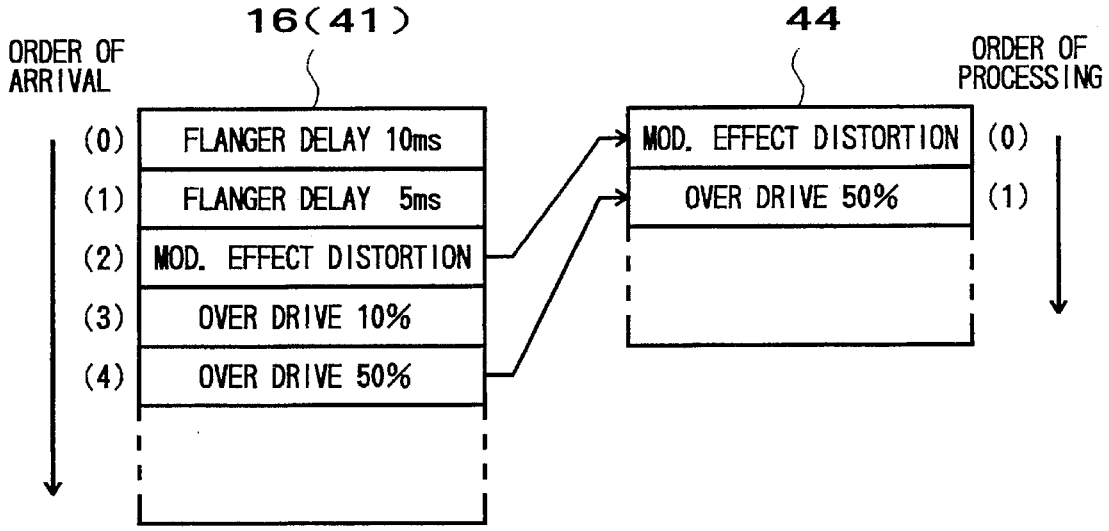
FIG. 5 is a diagram showing a manner in which a plurality of parameter change messages are enqueued into a queue buffer.

FIG. 5 illustrates a manner in which a plurality of the parameter change messages are enqueued in to the queue buffer 16. In the figure, the parameter change messages are being enqueued into the queue buffer 16 sequentially from the top address location of the buffer 16, in the order of their arrival. In the zeroth address location is enqueued a parameter change message "Flanger Delay 10 ms" instructing that the delay time of the flanger effect should be changed to 10 ms. In the first address location is enqueued a parameter change message "Flanger Delay 5 ms" instructing that the delay time of the flanger effect should be changed to 5 ms. In the second address location is enqueued a parameter change message "Mod. Effect Distortion" instructing that the modulation effect type should be changed to the distortion effect. In the third address location is enqueued a parameter change message "Overdrive 10%" instructing that the overdrive amount of the distortion effect should be changed to 10%. Further, in the fourth address location is enqueued a parameter change message "Overdrive 50%" instructing that the overdrive amount of the distortion effect should be changed to 50%.

According to the conventional task processing system, the parameter change operations are simply performed in the order in which the parameter change messages were arrived. Thus, after the parameter change parameter "Flanger Delay 10 ms" of the zeroth address has been executed to change the flanger delay time to 10 ms, the next parameter change message "Flanger Delay 5 ms" of the first address is executed to further change the flanger delay time to 5 ms. Also, immediately after the flanger delay time change, the parameter change message "Mod. Effect Distortion" of the second address is executed to change the modulation effect type from flanger to distortion. Then, shortly after the parameter change message "Overdrive 10%" of the third address location has been executed, the parameter change message Overdrive 50% of the fourth address location is executed to change the overdrive amount of the distortion effect.

To avoid such wasteful operations in the conventional system, the task processing in accordance with this embodiment is so designed to efficiently process the respective messages contained within the individual tasks, as will be described in detail with reference to FIGS. 6 and 7.

Figure 6:
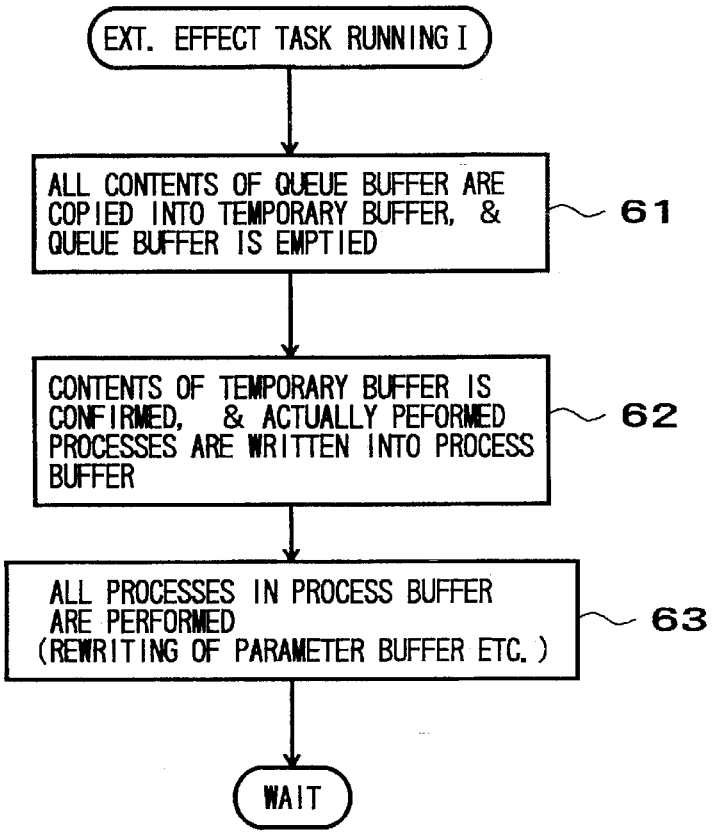
FIG. 6 is a flowchart illustrating an example of a process performed by a CPU when the external effect task is in the running state.

FIG. 6 is a flowchart of a process performed by the CPU during a running state of the external effect task 15 of FIG. 1. The process of FIG. 6 is represented as "Ext. Effect Task Running I" and is carried out in the following step sequence.

Step 61: Once the external effect task 15 has been brought into the running state, all the messages are dequeued from the queue buffer 16 and copied into the temporary buffer 41. This operation causes the queue buffer 16 to be empty, so that there will be no possibility of the buffer 16 being overflowed when any of the other tasks writes data thereinto. Therefore, a small-capacity memory area can be assigned as the queue buffer 16.

Step 62: The messages stored in the temporary buffer 41 are analyzed so that only the messages for actually performed processes are written into the process buffer 42.

Step 63: All the messages written in the process buffer 42 are processed in order to rewrite the contents of the parameter buffer 43.

Figure 7:
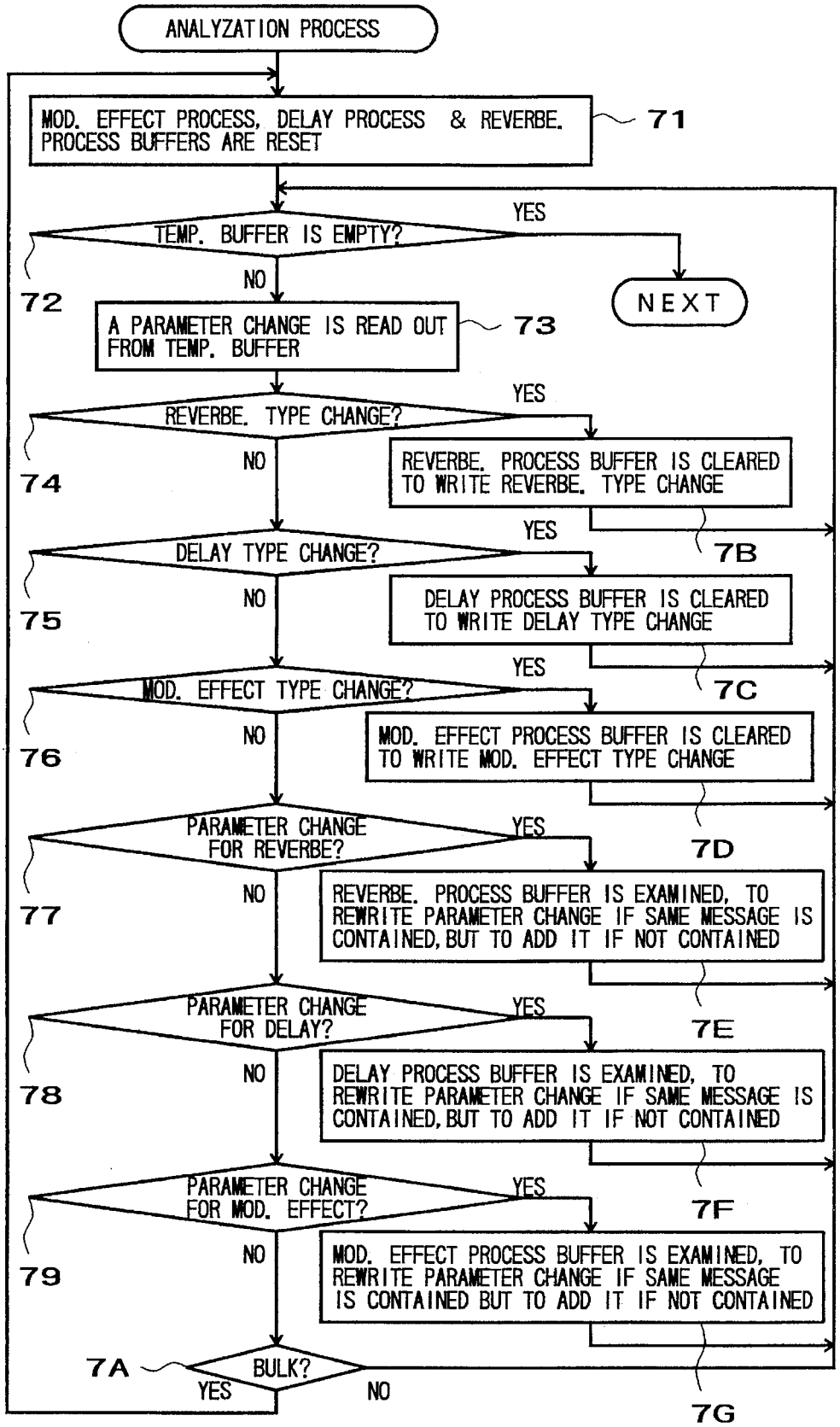
FIG. 7 is a flowchart illustrating the detail of a message analyzation operation executed in step 62 of FIG. 6.

FIG. 7 illustrates the detail of the massage analyzation operation of the above-mentioned step 62 which is carried out in the following step sequence.

Step 71: Individual buffers within the process buffer 42, i.e., modulation process, display process and reverberation process buffers are all reset to zero.

Step 72: A determination is made as to whether or not the temporary buffer 41 is empty. If the determination is in the affirmative (YES), the program goes to step 63 of FIG. 6; however, if any data is present in the temporary buffer 41, the program proceeds to step 73.

Step 73: A single parameter change message is read out from the temporary buffer 41.

The type of the read-out parameter change message is determined in the following steps 74 to 7A, and operations corresponding to the parameter change message are carried out in steps 7B to 7G.

Step 74: It is determined whether the read-out parameter change message is the one instructing a change in the reverberation type (Reverbe. Type Change). With a determination of YES, the program goes to step 7B, whereas with a determination of NO, the program proceeds to step 75.

Step 75: It is further determined whether the read-out parameter change message is the one instructing a change in the delay type (Delay Type Change). With a determination of YES, the program goes to step 7C, whereas with a determination of NO, the program proceeds to step 76.

Step 76: It is further determined whether the read-out parameter change message is the one instructing a change in the modulation effect type (Mod. Effect Type Change). With a determination of YES, the program goes to step 7D, whereas with a determination of NO, the program proceeds to step 77.

Step 77: It is further determined whether the read-out parameter change message is the one instructing change in the individual reverberation parameters (Parameter Change for Reverbe.). With a determination of YES, the program goes to step 7E, whereas with a determination of NO, the program proceeds to step 78.

Step 78: It is further determined whether the read-out parameter change message is the one instructing change in the individual parameters for the delay (independent and cross-delays) effect (Parameter Change for Delay). With a determination of YES, the program goes to step 7F, whereas with a determination of NO, the program proceeds to step 79.

Step 79: It is further determined whether the read-out parameter change message is the one instructing change in the individual parameters of the modulation effects (flanger, pitch changer and distortion; Parameter Change for Mod.). With a determination of YES, the program goes to step 7G, whereas with a determination of NO, the program proceeds to step 7A.

Step 7A: A determination is made as to whether the read-out parameter change message is the one instructing bulk dump. With a determination of YES, the program goes to step 71, whereas with a determination of NO, the program proceeds to step 72.

Step 7B: Because of the determination in step 74 that the read-out parameter change message is the one instructing a change in the reverberation type (Reverbe. Type Change), this step clears the reverberation process buffer 46 so as to write the reverberation type change message into the buffer 46.

Step 7C: Because of the determination in step 75 that the read-out parameter change message is the one instructing a change in the delay type (Delay Type Change), this step clears the delay process buffer 45 so as to write the delay type change message into the buffer 45.

Step 7D: Because of the determination in step 76 that the read-out parameter change message is the one instructing a change in the modulation effect type (Mod. Effect Type Change), this step clears the modulation effect process buffer 44 so as to write the modulation effect type change message into the buffer 44.

Step 7E: Because of the determination in step 77 that the read-out parameter change message is the one instructing change in the individual reverberation parameters (Parameter Change for Reverbe.), this step examines the stored contents of the reverberation process buffer 46, so that if the buffer 46 contains a same message as the current parameter change message, the step rewrites the same message as the current message, but otherwise, the step additionally writes the current message into the buffer 46.

Step 7F: Because of the determination in step 78 that the read-out parameter change message is the one instructing change in the individual delay parameters (Parameter Change for Delay), this step examines the stored contents of the delay process buffer 45, so that if the buffer 45 contains a same message as the current parameter change message, the step rewrites the same message as the current message, but otherwise, the step additionally writes the current message into the buffer 45.

Step 7G: Because of the determination in step 79 that the read-out parameter change message is the one instructing change in the individual parameters of the modulation effects (flanger, pitch changer and distortion; Parameter Change for Mod. Effect), this step examines the stored contents of the modulation effect process buffer 44, so that if the buffer 44 contains a same message as the current parameter change message, the step rewrites the same message as the current message, but otherwise, the step additionally writes the current message into the buffer 44.

Now, a description will be given on how the message analyzation process of FIG. 7 writes the contents of the temporary buffer 41 of FIG. 5 into the modulation effect process buffer 44 of the process buffer 42.

First, in step 71 of FIG. 7, the contents of the process buffer 42 are all reset to zero as previously noted. Since the temporary buffer 41 contains such messages as shown in FIG. 5, a NO determination is obtained in step 72 so that the operations in and after step 73 are performed.

First, from the temporary buffer 41 is read out the parameter change message "Flanger Delay 10 ms" of the zeroth address. Because this message is the one instructing change in flanger parameters of the modulation effect (Parameter Change for Mod. Effect), an YES determination is obtained in step 79 so that the operation of step 7G is performed. In step 7G, because the modulation effect process buffer does not contain a same message as the parameter change message, the parameter change message "Flanger Delay 10 ms" is newly written into the zeroth address location of the modulation effect process buffer 44.

Since the temporary buffer 41 is not empty, the parameter change message "Flanger Delay 5 ms" is then read out from the first address of the buffer 41. This message is the one instructing change in the flanger parameters for the modulation effect (Parameter Change for Mod. Effect), and thus, again, an YES determination is obtained in step 79 so that the operation of step 7G is performed. In step 7G, because the modulation effect process buffer 44 contains the same parameter change message, i.e., the last parameter change message "Flanger Delay 10 ms", this parameter change message "Flanger Delay 10 ms" is rewritten into the new parameter change message "Flanger Delay 5 m".

Since the temporary buffer 41 is not empty, the parameter change message "Mod. Effect Distortion" of the second address is read out from the buffer 41. The read-out message is the one instructing a change in the modulation effect type (Mod. Effect Type Change), and thus an YES determination is obtained in step 76, so that the operation of step 7D is performed. This step 7D clears the modulation effect process buffer 44 of the process buffer 42 and writes the modulation effect type change message into the buffer 44. In this manner, the last-written parameter change message (Flanger Delay 5 ms) is deleted from the modulation effect process buffer 44, and the modulation effect type change message (Mod. Effect Type Change) is newly written into the zeroth address of the buffer 44.

Since the temporary buffer 41 is not empty, the parameter change message "Overdrive 10%" of the third address is read out from the buffer 41. The read-out message is the one instructing change in the distortion parameters for the modulation effect (Parameter Change for Mod. Effect), and thus an YES determination is obtained in step 79, so that the operation of step 7G is performed. Since the modulation effect process buffer 44 contains the same parameter change message, this step 7G newly writes the parameter change message "Overdrive 10%" into the first address of the buffer 44.

Since the temporary buffer 41 is not empty, the parameter change message "Overdrive 50%" is then read out from the fourth address of the buffer 41. This message is the one instructing change in the distortion parameters for the modulation effect (Parameter Change for Mod. Effect), and thus, again, an YES determination is obtained in step 79 so that the operation of step 7G is performed. In step 7G, because the modulation effect process buffer 44 contains the same parameter change message, i.e., the last parameter change message "Overdrive 10%", this parameter change message "Overdrive 10%" is changed into the new parameter change message "Overdrive 50%".

In this manner, the modulation effect process buffer 44 is rewritten as shown in FIG. 5. Namely, a message indicative of the modulation type (Mod. Effect Distortion) and a message indicative of the distortion overdrive amount (Overdrive 50%) are stored into the zeroth and first address locations of the modulation effect process buffer 44, respectively. These messages are processed in step 63. On the other hand, the other messages (Flanger Delay 10 ms, Flanger Delay 5 ms and Overdrive 10%) having so far been stored in the temporary buffer 41 will not be executed. As compared to the prior art technique where all the messages are processed, this embodiment executes only effective messages, thus greatly enhancing the processing efficiency of the device.

Next, a description will be made on another embodiment of the task processing in accordance with the present invention.

Figure 8:
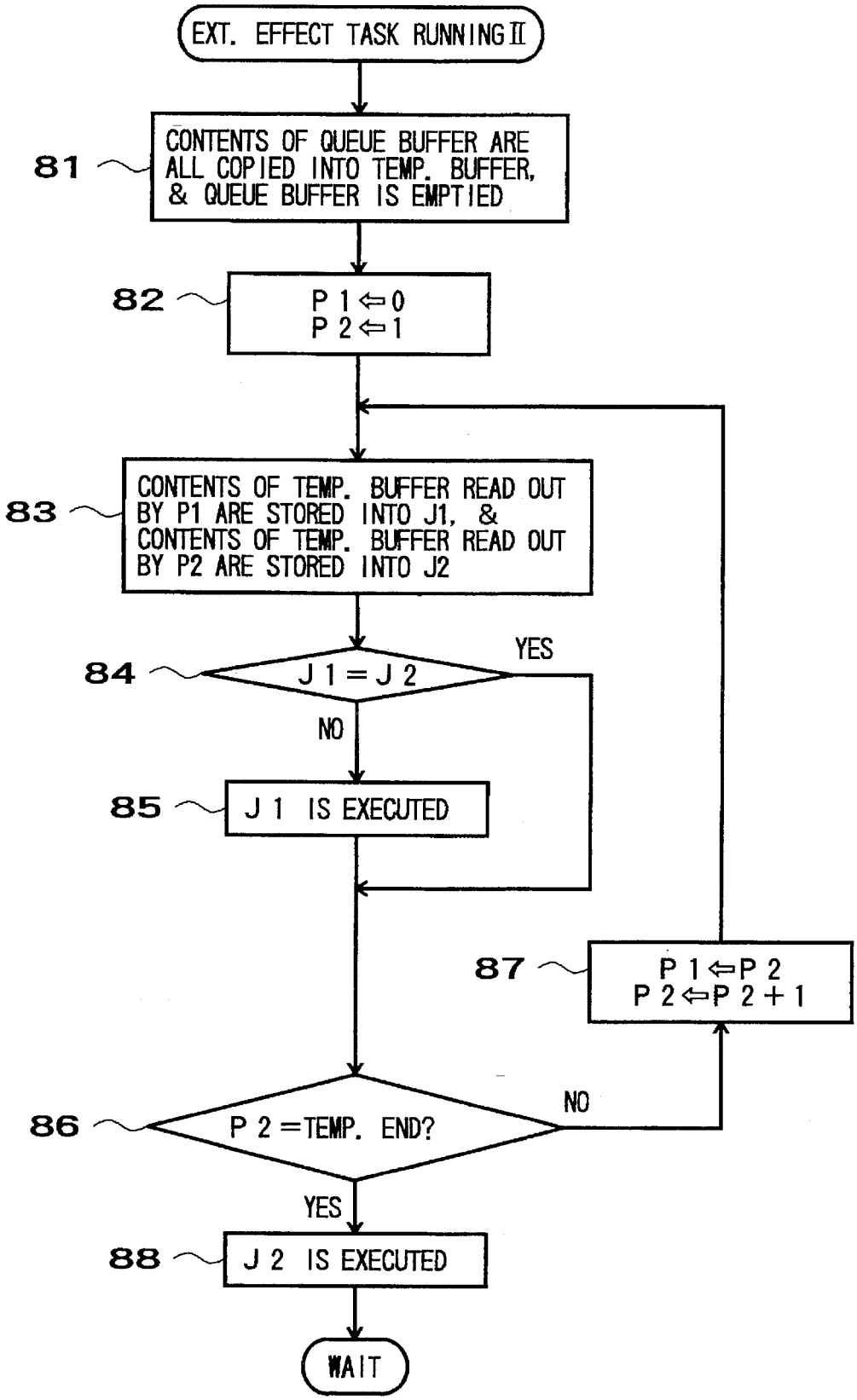
FIG. 8 is a flowchart illustrating another example of the process performed by the CPU when the external effect task is in the running state.

FIG. 8 is a flowchart illustrating another example of a process performed by the CPU during a running state of the external effect task 15 of FIG. 1. The process of FIG. 8 is represented as "Ext. Effect Task Running II" and is carried out in the following step sequence.

Step 81: Once the external effect task 15 has been brought into the running state, all the messages are dequeued from the queue buffer 16 and copied into the temporary buffer 41. This operation causes the queue buffer 16 to be empty.

Step 82: Values "0" and "1" are set into the variable register P1 and P2, respectively. The values "0" and "1" indicate addresses of the temporary buffer 41.

Step 83: The contents of the temporary buffer 41 read out in accordance with the variable register P1 are stored into a first message register J1, and at the same time, the contents of the temporary buffer 41 read out in accordance with the variable register P2 are stored into a second message register J2.

Step 84: A determination is made as to whether the contents of the messages stored in the first and second message register J1 and J2 are the same, i.e., whether the same type of messages are in succession. If the determination is in the affirmative, the program jumps to step 86; otherwise, the program goes to step 85.

Step 85: Because of the determination in step 84 that the same type of messages are not in succession, this process executes the message stored in the first message register J1.

Step 86: It is determined whether the variable register P2 has reached a last value at the message storing addresses in the temporary buffer 41. With a determination of YES, the program proceeds to step 88; with a determination of NO, the program reverts to step 83 after having performed the operation of step 87.

Step 87: The value contained in the variable register P2 is set into the variable register P1, and then the register P2 is incremented by only one. This operation causes the read-out value from the temporary buffer 41 to be incremented one by one.

Step 88: Because of the determination in the preceding step 86 that the variable register P2 has reached the final value, this step executes the final message stored in the second message register J2 to bring the operation mode of the device into the task wait state.

Now, a description will be given on a manner in which the messages stored in the temporary buffer 41 of FIG. 5 are processed.

First, by the operation of step 81 of FIG. 8, all the messages are copied into the temporary buffer 41. Then, by the operation of step 82, "0" is set into the variable register P1, and "1" is set into the variable register P2.

After that, the stored value "0" in the variable register P1, i.e., the parameter change message "Flanger Delay 10 ms" of the zeroth address of the temporary buffer 41 is stored into the first message register J1, and the stored value "1" in the variable register P2, i.e., the parameter change message "Flanger Delay 5 ms" of the first address of the buffer 41 is stored into the second message register J2.

As the result of the determination in step 84 that the messages set in the first and second message registers J1 and J2 are of the same type, the program proceeds to step 86. At this time, the parameter change message having been so far stored in the first parameter change (Flanger Delay 10 ms) is prevented from being executed.

Because step 86 determines that the stored value "2" in the variable register P2 is not the final value contained at the message storing addresses of the temporary buffer 41, the operation of step 87 is performed so that the stored value in the variable register P1 becomes "1" and the stored value in the variable register P2 is incremented to "2".

In step 83, the stored value "1" in the variable register P1, i.e., the parameter change message "Flanger Delay 5 ms" of the first address of the temporary buffer 41 is stored into the first message register J1, and the stored value "2" in the variable register P2, i.e., the parameter change message "Mod. Effect Distortion" of the second address of the buffer 41 is stored into the second message register J2.

As the result of the determination in step 84 that the messages set in the first and second message registers J1 and J2 are not of the same type, the program proceeds to step 85 so as to execute the parameter change message "Flanger Delay 5 ms" set in the first message register J1.

Because the stored value "2" in the variable register P2 is not the final value contained at the message storing addresses of the temporary buffer 41, the operation of step 87 is again performed so that the stored value in the variable register P1 becomes "2" and the stored value in the variable register P2 becomes "3".

At this time, the stored value "2" in the variable register P2, i.e., the parameter change message "Mod. Effect Distortion" of the second address of the temporary buffer 41 is stored into the first message register J1, and the stored value "3" in the variable register P2, i.e., the parameter change message "Overdrive 10%" of the third address of the buffer 41 is stored into the second message register J2.

As the result of the determination in step 84 that the messages set in the first and second message registers J1 and J2 are not of the same kind, the program proceeds to step 85 so as to execute the parameter change message "Mod. Effect Distortion" set in the first message register J1.

Because the stored value "3" in the variable register P2 is not the final value contained at the message storing addresses of the temporary buffer 41, the operation of step 87 is again performed so that the stored value in the variable register P1 becomes "3" and the stored value in the variable register P2 becomes "4".

Then, the stored value "3" in the variable register P2, i.e., the parameter change message "Overdrive 10%" of the third address of the temporary buffer 41 is stored into the first message register J1, and the stored value "4" in the variable register P2, i.e., the parameter change message "Overdrive 50%" of the third address of the buffer 41 is stored into the second message register J2.

Because the determination in step 84 is that the messages set in the first and second message registers J1 and J2 are of the same type, the program proceeds to step 86. But, at this time, the stored value "4" in the variable register P2 is the final value contained at the message storing addresses of the temporary buffer 41, the operation of step 88 is performed so as to execute the parameter change message "Overdrive 50%" set in the first message register J2.

According to the embodiment of FIG. 8 as described above, the parameter change messages "Flanger Delay 10 ms" and "Overdrive 10%" of the zeroth and third addresses are not executed. This means that the embodiment of FIG. 8 executes one more message than the embodiment of FIGS. 6 and 7, but can reduce the total number of steps required and is substantially simplified as a whole.

Next, a description will be made on another embodiment of the task processing of the present invention with reference to FIG. 9.

Figure 9:
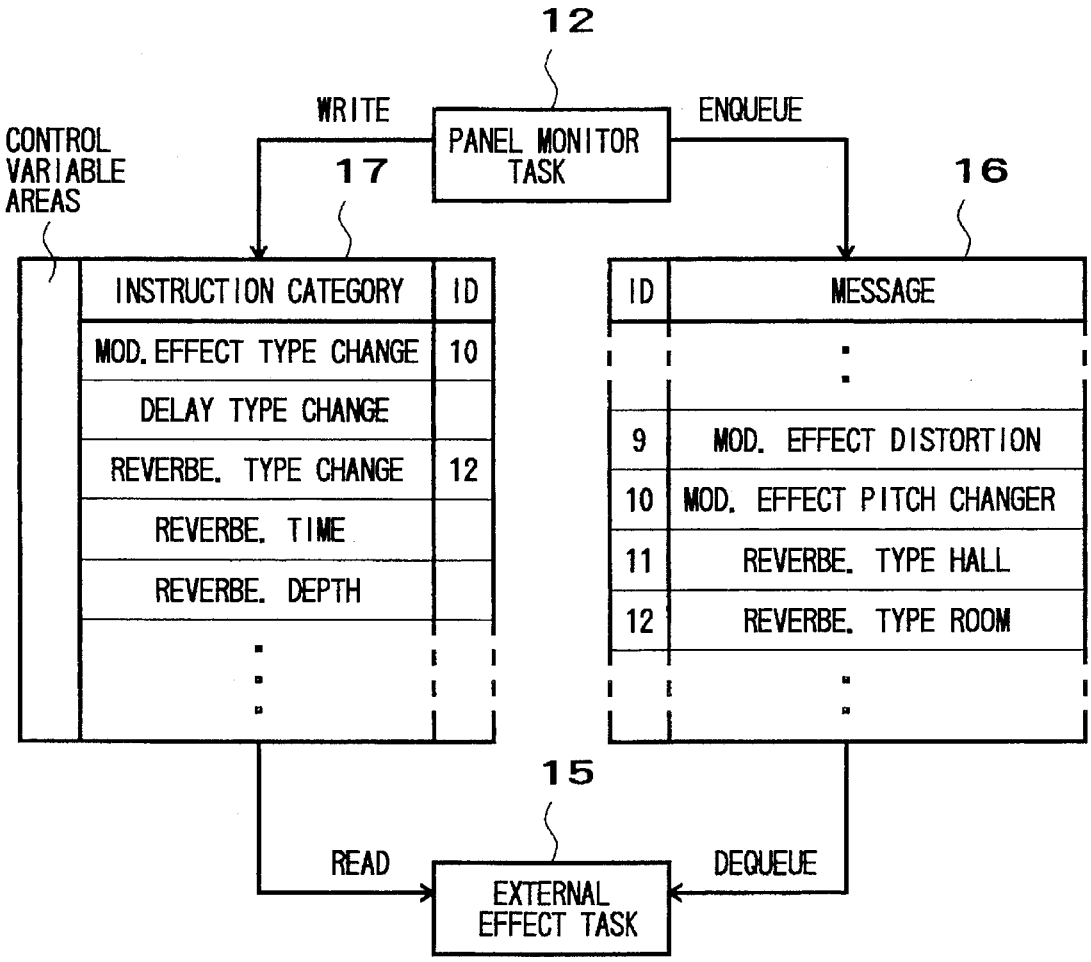
FIG. 9 is a diagram illustrating another embodiment of the present invention where task processing is performed by providing, separately from the queue buffer, a control variable register between a panel monitor task and the external effect task of FIG. 1.

In the embodiment of FIG. 9, the task processing is performed by providing, separately from a queue buffer 16, a control variable register 17 between a panel monitor task 14 and an external effect task 15 as in the example of FIG. 1.

The control variable register 17 has a plurality of instruction category areas corresponding to a plurality of parameter change messages, such as one instructing a change in the modulation effect type (Mod. Effect Type Change), one instructing a change in the delay type (Delay Type Change), one instructing a change in the reverberation type (Reverbe. Type Change), one instructing a reverberation time (Reverbe. Time) and one instructing a reverberation depth (Reverbe. Depth). In the individual instruction category areas are also stored identification numbers that are identical to those of the parameter change messages written in the queue buffer. These identification numbers are serial numbers of the parameter change messages having been written into the queue buffer 16 since the program was reset.

In the queue buffer 16, the parameter change messages are enqueued in the order of the respective identification numbers; for example, a message "Mod. Effect Distortion" belonging to the instruction category "Mod. Effect Type Change" is enqueued with identification number "9", a message "Mod. Effect Pitch Changer" also belonging to the instruction category "Mod. Effect Type Change" is enqueued with identification number "10", a message "Reverbeo Type Hall" belonging to the instruction category "Reverbe. Type Change" is enqueued with identification number "11", and a message "Reverbe. Type Room" also belonging to the instruction category "Reverbe. Type Change" is enqueued with identification number "12".

When messages belonging to the same instruction category are sequentially enqueued, their identification numbers are sequentially written in the corresponding instruction category area of the control variable register 17. More specifically, in the case of FIG. 9, the identification number "9" is written into the instruction category area "Mod. Effect Type Change" when the message "Mod. Effect Distortion" of the identification "9" has been enqueued. After that, once the message "Mod. Effect Pitch Changer" of identification "10" has been enqueued, the identification number "10" is written into the instruction category area "Mod. Effect Type Change". In a similar manner, identification number "12" is written into the instruction category area "Reverbe. Type Change".

When dequeuing any message from the queue buffer 16, the external effect task 15 executes or does not execute the message, depending on whether the identification number assigned to the message is identical to that stored in the area corresponding to the message of the same category contained in the control variable register 17. For example, in the case of FIG. 9, since the message "Mod. Effect Distortion" has identification number "9" that is different from that of the same instruction category "Mod. Effect Type Change", this message is not executed. Similarly, the message "Reverbe. Type Hall" has identification "11" that is different from that of the same instruction category "Reverbe. Type Change" and hence is not executed.

In this manner, the embodiment of FIG. 9 can selectively execute only effective messages, thereby greatly enhancing the task processing efficiency.

It should be understood that although the above embodiments have been described in relation to the external effect task, they may also be applied to such a task where parameters may sequentially be rewritten within a relatively short range and the processed contents are not essentially affected irrespective of the rewritten parameters. However, in such a case, the parameters need to be of modeless nature.

It should be also understood that the present invention may be applied to not only a musical instrument but also a sound signal processor or the like.

According to the present invention as has been described so far, selective processing can be made only some of the messages stored within a task which are considered highly necessary, and therefore it is possible to greatly enhance the task processing efficiency.

What is claimed:

1. An electronic musical instrument provided with a multi-task processing function comprising:

buffer memory means for storing messages given to a specific task in order of arrival; and processing means for performing message processing on the basis of the messages stored in said buffer memory means, in a different order from the order of arrival, wherein said processing means includes determination means for determining contents of plural unprocessed ones of the messages stored in said buffer memory means, so as to invalidate each of the messages which is currently meaningless and to validate each of the messages which is currently meaningful, and means for processing the message validated by said determination means.

2. An electronic musical instrument as defined in claim 1 wherein said processing means processes the unprocessed messages in said buffer memory means in order, and if a specific one of the messages indicates a change in a preceding message, said processing means invalidates the preceding message to process the specific message.

3. An electronic musical instrument as defined in claim 1 wherein said processing means includes temporary buffer means for rearranging the unprocessed messages in said buffer memory means, said processing means performing the message processing in accordance with a contents of said temporary buffer means.

4. An electronic musical instrument as defined in claim 1 wherein said specific task has a relatively lower priority among plural tasks which have been processed in said electronic musical instrument.

5. An electronic musical instrument according to claim 1, further comprising:

checking means for checking the messages stored in said buffer memory means so that when a message instructing a change in a preceding message is given with the preceding message unprocessed, said checking means cancels processing of the preceding message.

6. An electronic musical instrument provided with a multi-task processing function comprising:

buffer memory means for storing a plurality of messages given to a specific task in order of arrival; and processing means for performing message processing on the basis of the plurality of messages stored in said buffer memory means, in a different order from the order of arrival, wherein said processing means includes distinguishing means for, of plural unprocessed messages in said buffer, distinguishing messages which are currently meaningless from messages which are currently meaningful based on a respective content of said messages, pointing-out means for pointing out the meaningful messages in accordance with a distinction by said distinguishing means, and means for processing only the messages pointed out by said pointing-out means.

7. An electronic musical instrument as defined in claim 6 wherein the distinguishing means includes classifying means for classifying said plurality of messages into plural message categories, and said pointing-out means points out the meaningful message for each of the plural message categories.

8. An electronic musical instrument provided with a multi-task processing function comprising:

buffer memory means for storing a plurality of messages given to a specific task in order of arrival;

categorizing means for categorizing said plurality of messages stored in said buffer memory means into respective categories based on a message type and an order in which said plurality of messages are stored in said buffer memory means; and processing means for processing said plurality of messages, wherein said processing means only processes one message in a category which is last in order of arrival when plural messages of a same category are stored in said buffer memory means.

* * * * *